United States Patent [19]

Albright et al.

[11] Patent Number: 4,469,246

[45] Date of Patent: Sep. 4, 1984

[54] SINGLE VEND NEWSPAPER APPARATUS

[75] Inventors: Henry J. Albright, West Des Moines; Arthur N. Wirstlin, Altoona, both of Iowa

[73] Assignee: Fawn Engineering Company, Des Moines, Iowa

[21] Appl. No.: 398,107

[22] Filed: Jul. 14, 1982

[51] Int. Cl.[3] ..... B65H 3/06

[52] U.S. Cl. ..... 221/225; 221/231

[58] Field of Search ..... 221/213–216, 221/259, 227, 230, 231, 237, 241, 225; 271/22, 38, 109

[56] References Cited

U.S. PATENT DOCUMENTS

| | | | |
|---|---|---|---|
| 1,257,153 | 2/1918 | Turney . | |
| 1,708,234 | 4/1929 | Nelson . | |
| 1,886,694 | 11/1932 | Kelly | 221/231 X |
| 2,010,373 | 8/1935 | Pinkenburg . | |
| 2,501,434 | 3/1950 | Cameron . | |
| 3,708,087 | 1/1973 | Schonthal . | |
| 3,747,733 | 8/1973 | Knickerbocker . | |
| 3,917,114 | 11/1975 | Grosse | 221/259 X |
| 4,067,477 | 1/1978 | Chalabian . | |

FOREIGN PATENT DOCUMENTS

| | | | |
|---|---|---|---|
| 39015 | 6/1913 | Sweden | 221/231 |

*Primary Examiner*—Stanley H. Tollberg

*Attorney, Agent, or Firm*—Henderson & Sturm

[57] ABSTRACT

Apparatus for dispensing newspapers, one at a time, having a frame with a wheel assembly movably attached thereto is provided for having wheels in contact with a stack of newspapers. The wheels have one-way bearings such that when the wheel assembly is pulled in a first direction, the wheels will not rotate and thereby frictionally engage a newspaper in contact therewith, thereby pulling the newspaper with the wheels. When the wheel assembly is pushed back in a second direction, opposite to the first direction, then the wheels are allowed to rotate against the next newspaper to be dispensed, to assume a ready position for the next operation. An assist mechanism is also provided for assisting the frictional engagement of a newspaper by the wheels and such assist mechanism has an adjustable feature for use with thin papers in one position thereof, or thick papers in another position thereof.

6 Claims, 10 Drawing Figures

SINGLE VEND NEWSPAPER APPARATUS

BACKGROUND OF THE INVENTION

The present invention relates generally to newspaper vending machines, and more particularly to a type of newspaper vending machine which will dispense only a single newspaper at a time.

One of the simplest forms of newspaper vending machines is of a type which when the proper amount of money is inserted, will allow a door to open and to allow the customer to reach into the inside of the machine and obtain a newspaper from a stack of newspapers disposed therein. In this type of newspaper vending machine, there is nothing to prevent a person from paying for only one newspaper, but taking more than one newspaper out of the machine. Since this is a well-known problem, various other machines have been devised for vending only a single newspaper at a time. Examples of such machines are shown in U.S. Pat. Nos. 1,257,153; 1,708,234, 2,010,373; 2,501,434; 3,708,087; 3,747,733; and 4,067,477. For various reasons, these patented devices have not come into common commercial usage, and it is theorized that it is because these patented devices are either too expensive to produce or not reliable enough to withstand the abuse that these types of machines take on the street.

Consequently, there is a genuine need for newspaper vending machines which will vend a single paper at a time which is inexpensive to construct and reliable in its use.

SUMMARY OF THE INVENTION

The present invention relates to the vending machine for dispensing newspapers one at a time. A wheel assembly having at least one wheel attached thereto is movably mounted to the frame, and the wheels attached to the wheel assembly have one-way bearings therein. The wheels with one-way bearings therein are in abutment with the top one of the stack of newspapers so that when the wheel assembly and wheel are moved to a first position, the wheel will frictionally engage the newspaper and will not rotate as the newspaper is pulled at least partially out of the machine by such frictional engagement of the wheels and movement of the wheel assembly. Then the wheel assembly, can be moved back to the second position, opposite to the first position, and during such movement, the wheels will rotate over the newspaper in contact therewith so that it can reassume a position whereby it is ready to dispense the next newspaper.

An object of the present invention is to provide an improved apparatus for dispensing newspapers.

Another object of the invention is to provide a newspaper vending apparatus for dispensing newspapers one at a time.

A further object of the invention is to provide a single vend newspaper apparatus which is not unduly expensive or difficult to construct, but which is extremely reliable to use.

Other objects, advantages, and novel features of the present invention will become apparent from the following detailed description of the invention when considered in conjunction with the accompanying drawings.

DESCRIPTION OF THE PREFERRED EMBODIMENT

Figure 1:
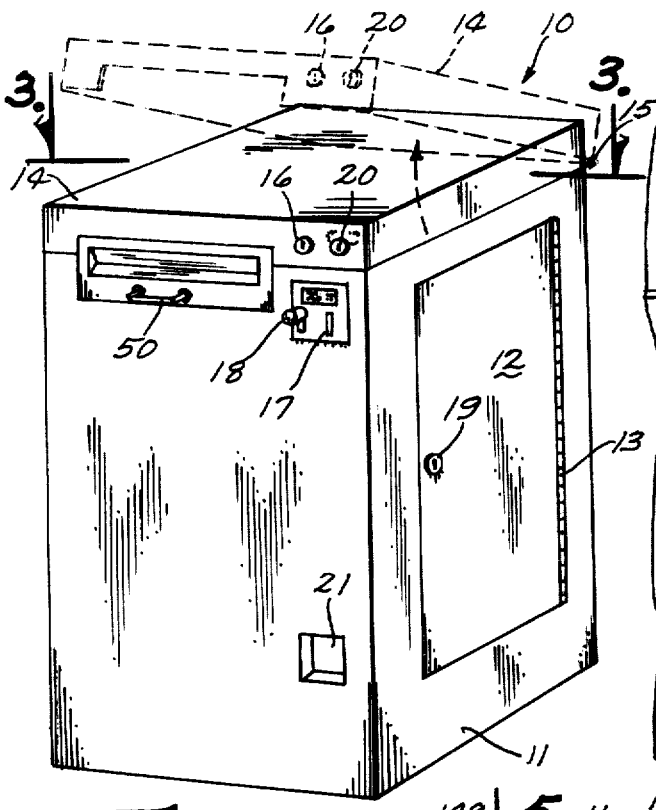
FIG. 1 is a perspective view of the exterior of a preferred embodiment of the present invention.

Referring now to the drawings wherein like reference numerals designate identical or corresponding parts throughout the several views, FIG. 1 shows a newspaper vending device 10 constructed in accordance with the present invention.

A frame housing 11 includes a door 12 which is connected to the frame housing 11 by means of a hinge 13. A lock 19 for opening with a key or locking the door 12 closed is provided.

The top lid 14 is pivotally connected at the rear thereof by another hinge 15 and still another key-type locking device 16 is provided at the front of the lid 14 for selectively locking the lid closed or allowing it to be opened; for example, as shown in dashed lines in FIG. 1. A coin slot 17 is provided on the front of the frame housing 11 for accepting coins in payment for newspapers as is well-known in this art, and additionally a coin return mechanism 18 is provided, as is well-known in this art. A coin return slot 21 is provided on the front of the frame housing 11 for catching the coins when the coin return mechanism is actuated. A switching mechanism 20 is provided on the top of the lid for accepting a key for changing the machine from dispensing daily papers to dispensing Sunday papers, and this key switching mechanism 20 changes not only the price needed to obtain a newspaper from the apparatus 10, but also changes the newspaper assist mechanism as will be explained below.

Figure 5:
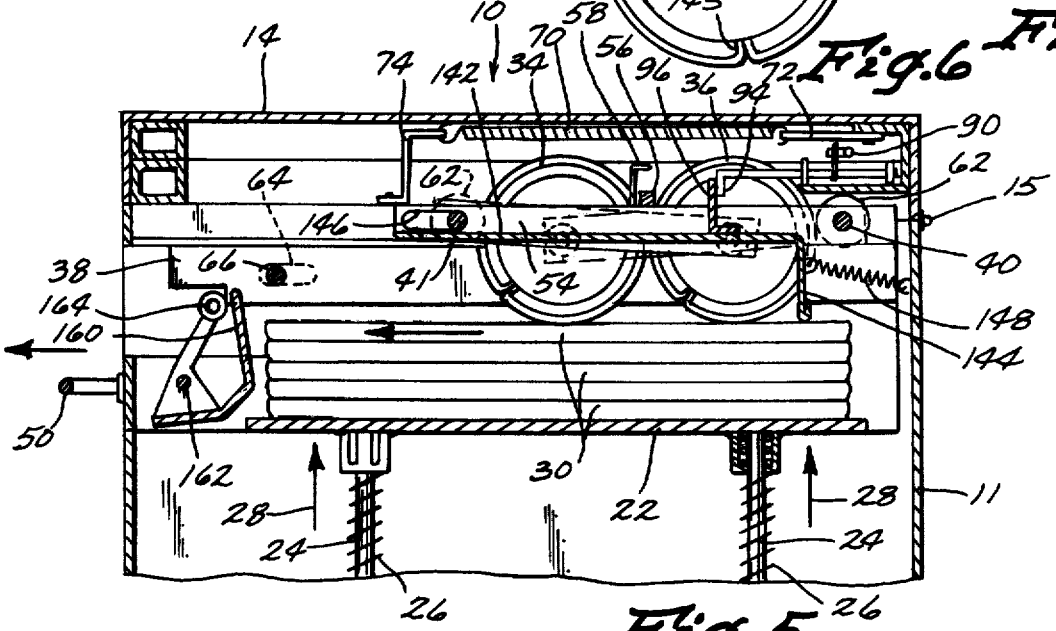
FIG. 5 is a partial cross-sectional view taken along line 5—5 of FIG. 3.

Referring now to FIG. 5, it is noted that a platform 22 is provided within the frame housing 11, and this platform 22 is supported by a plurality of rods 24. Four of these rods 24 are attached to the frame and each of these rods 24 has a spring 26 disposed therearound for the purpose of biasing the platform 22 in the direction of the arrows 28 (FIG. 5). A plurality of newspapers 30 are disposed on the platform 22, and these newspapers 30 are generally of a thin variety, not more than an inch or so in thickness.

Figure 3:
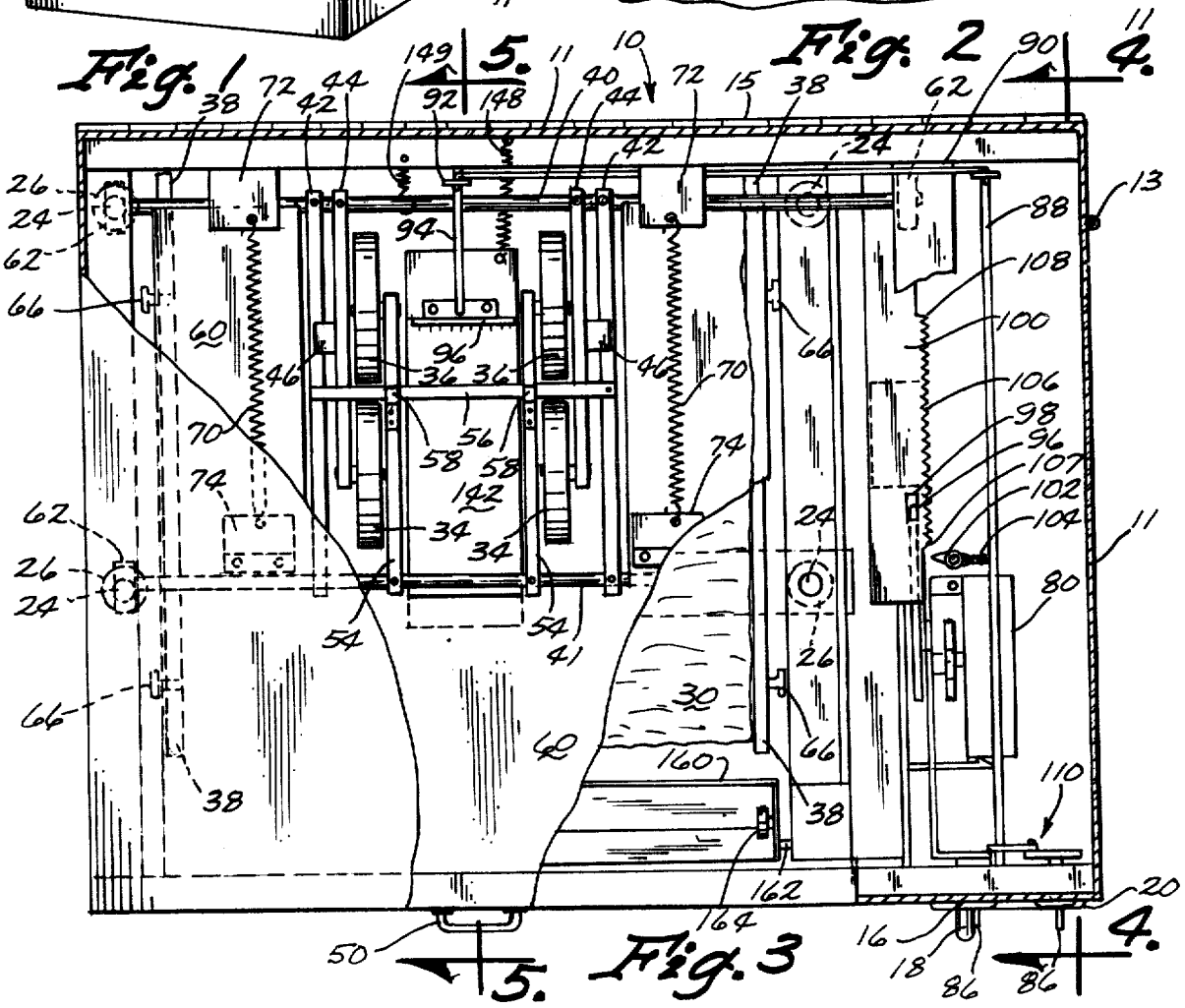
FIG. 3 is a top view of the present invention with various portions broken away to show various other portions underneath thereof.

A wheel assembly 32 is provided for holding the wheels 34 and 36 in their proper position against the top one of the newspapers 30. This wheel assembly 32 includes a framework 38 (FIG. 3) having a pair of rods 40 and 41 attached therebetween. This wheel assembly 32 also includes a pair of braces 42 attached to the rods 40 and 41 and being disposed on each side of the wheels 34 and 36. Referring to FIGS. 3 and 5, it will be noted that the front wheels 34 are rotatably attached to a member 44, which is pivotally attached to the rearmost rod 40. A stop 46 is rigidly attached to the member 44 so that when the lid 14 is raised in the position shown in dashed lines in FIG. 1, and the wheel assembly is also lifted by lifting the handle 50 of the framework 52 of the wheel assembly, the wheels 34 will not pivot downwardly beyond the position of contact of the stop 46 against the braces 42.

In a similar manner, the rear wheels 36 are rotatably attached to lever members 54, and these lever members 54 are pivotally attached to the front rod 41 of the wheel assembly 32. Also, a brace 56 is connected across to the braces 42. A L-shaped member 58 is connected to each of the lever members 54, as is clearly shown in FIGS. 3 and 5, for the purpose of preventing the rear wheels 36 from pivoting downwardly out of position when the lid 14 is raised to the position shown in FIG. 1 in dashed lines; and, at the same time, the handle 50 is used to pivot upwardly the frame assembly 32, including the front portion 52 thereof about the rod 40. It is only after the lid 14 is raised upwardly and the wheel assembly 32 is raised upwardly that newspapers 30 can be placed on top of the platform 22.

The wheel assembly 32 also includes a sheet metal top member 60 (FIG. 3) which extends over the newspapers 30 and generally to each side of the wheels 34 and 36 and their associated levers and stops. This sheet metal member 60 slides on top of the members 38 at each side thereof. Rollers 62 are attached at each end of the rods 40 and 41 and ride in tracks (not shown) which are attached to the frame housing 11 for reducing the friction involved in pulling the handle 50 outwardly. Four slots 64 are provided in the sidewall of the sheet metal member 60, and stop bolts 66 are threadably engaged into the members 38 at each side and under the sheet metal member 60. Consequently, it will be apparent that while the members 38 are attached to the rods 40 and 41 in a rigid fashion, the sheet metal member 60 is movable with respect to the rods 40 and 41 and the side members 38 to the extent that the sheet metal member 60 can move so that the cam opening 64 is in the position shown in FIG. 4 or in the position shown in FIG. 6 with respect to the stop member 66 which is rigidly attached to the members 38, which in turn are rigidly attached to the rods 40 and 41.

Figure 6:
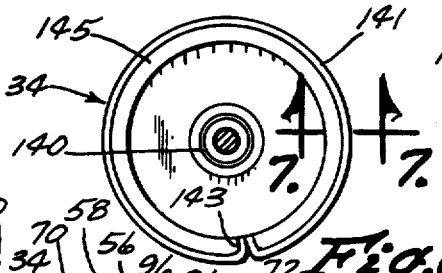
FIG. 6 is a side view of one of the wheels of the present invention.
Figure 7:
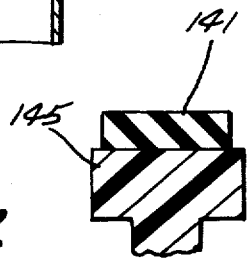
FIG. 7 is an enlarged partial cross-sectional view taken along line 7—7 of FIG. 6.

The wheels 34 and 36 are shown in more detail in FIGS. 6 and 7. The wheels 34 and 36 have a one-way bearing 140, as will be explained further below, and they have an outer rubber coating 141 which will increase the frictional contact with newspapers. This outer coating 141 is made by providing a slot 143 in the base plastic portion 145 of the wheel 34 so that each of the ends of the plastic coating 141 can be tucked into the slot 143 to hold the ends in position.

A pair of tension springs 70, as can best be seen in FIGS. 3 and 5, are attached to the back of the machine frame 11 by means of a tab 72; and, at the other end, the springs 70 are attached to the top of the sheet metal member 60 by means of a bracket 74, which is rigidly attached to the top of the sheet metal member 60. Consequently, the springs 70 tend to pull the sheet metal member 60 into the position shown in FIGS. 3 and 5 and likewise will operate to pull the members 38 and rods 40 and 41 to the right as viewed from the FIG. 5 position, thereby pulling the entire wheel assembly structure to such FIG. 5 retracted position.

A spring 149 as shown in FIG. 3 is attached to the rearmost rod 40 and to the frame 11. This spring 149 is a tension spring for preventing the wheel assembly 32 from moving with the handle 50 and the sheet metal member 60 during the initial movement of the two members, wherein these members 50 and 60 can move the initial distance as represented by the movement of the slot 64 with respect to the pin 66, as shown in FIG. 5, to the position shown in FIG. 8. If this feature was not present, a person trying to defeat a security aspect of the machine 10 could make short pulls on the handle 50, and cause slight movement of the wheels 34 and 36 which, through repeated movements, would work a newspaper out through the top of the machine without paying for such newspaper.

Figure 4:
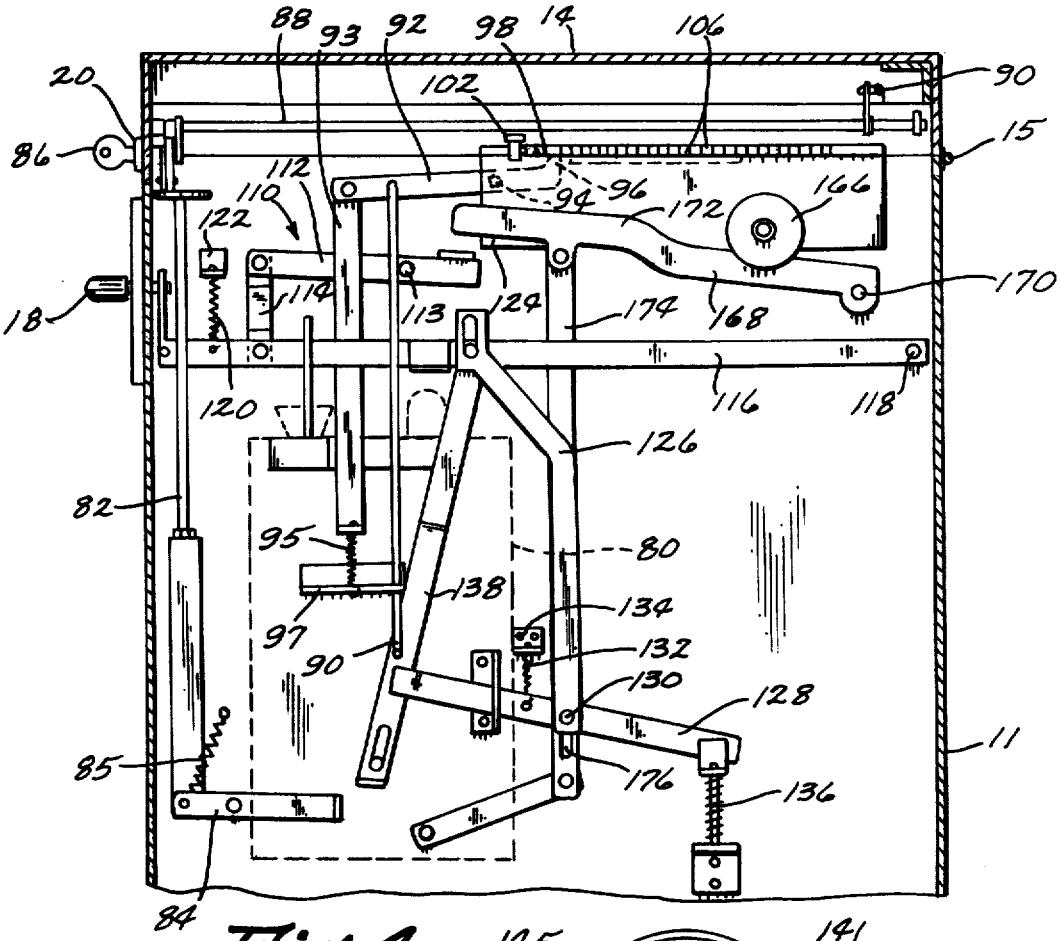
FIG. 4 is a cross-sectional view taken along 4—4 of FIG. 3.

In operation, coin mechanism 80, as shown in dashed lines in FIG. 4, will have been set by means of the linkages 82, 83 and 84 which are biased by a tension spring 85 as well. This coin mechanism 80 is of a standard construction well-known in the art, for example as shown in U.S. Pat. Nos. 3,139,167 and 3,545,586. At the same time that the key 86, as shown in FIG. 4, is used to turn the structure 20 to the position shown in FIG. 2 and set the price of the coin mechanism 80 for actuation at twenty-five cents (25c) (for example) for a daily paper, the rod 88 will be moved, and the rod 88 will, in turn, move the rod 90, which will pull the lever 92 (FIG. 5) and thereby turn the locking finger 94 to the position shown in FIG. 5, whereby it is in abutment with the bracket 96 for a purpose which will be explained below.

Figure 2:
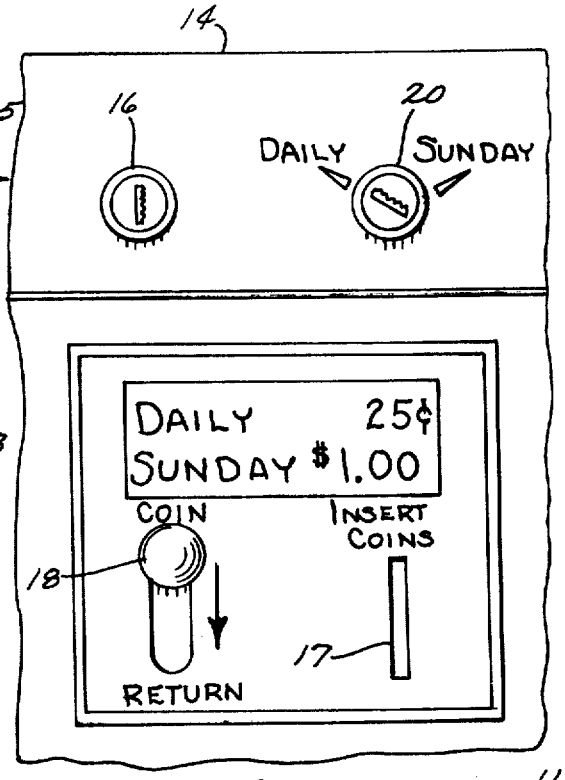
FIG. 2 is an enlarged view of the front of the machine showing the coin slot, coin return, lock and switching mechanism for switching between different thicknesses and prices of newspapers.

Consequently, when the proper amount of money is placed in the coin slot 17, for example twenty-five cents (25c) in the example shown in FIG. 2, the coin mechanism 80 will prevent the rod 90 from moving downwardly beyond the position shown in FIG. 4, which will hold the lever 92, which is pivotally attached at the point 94 to the frame, and so that when the handle 50 is pulled outwardly from the apparatus 10 or to the left as shown in FIGS. 4 and 5, the handle 50 will be able to move outwardly without being locked up. If the proper amount of money has not been placed in the coin mechanism 80, then the cam (not shown) on the coin mechanism 80 will not hold the rod 90 upwardly and so when the handle 50 is pulled to the left as shown in FIG. 4, the left part of the rod 92 will pivot downwardly and the rightmost upwardly extending portion 96 of the rod 92 will move upwardly and into the slot 98 in the member 100, as shown in FIGS. 3 and 4.

When the end 96 of the member 92 moves up into the slot 98, because the handle 50 has been pulled outwardly to a slight degree, this action of part 96 in slot 98 will prevent the wheel assembly 32 from being pulled out without enough money having first been placed into the vending apparatus 10. Referring to FIG. 3, it is noted that the position of the member 100 when the handle 50 is completely pushed in is such that the end 96 is not aligned directly with the slot 98. This arrangement is deliberate, because in this position shown in FIG. 3, the lever 92 will be held in the position shown in FIG. 4; i.e., the upward part of such lever 92, 96, will rest against the member 100 just in front of the slot 98 and therefore will hold the rod 90 upwardly so it will not interfere with the movement of the cam on the coin mechanism unit 80. The left end of the lever 92 is biased downwardly as viewed in FIG. 4 by a tension spring 97 connected to lever 93 and a bracket 97 connected to the frame.

Once the proper amount of money has been placed into the machine and the handle 50 is pulled outwardly from the machine 10; and, furthermore, after the slot 98 in member 100 has moved past the end 96 of the lever 92, then a ratchet member 102, which is pivotally attached to a portion of the frame housing 11 and is baised to the position shown by a spring 104 (also attached at one end to the ratchet 102 and at the other end to a portion of the frame 11) will operate to engage the ratchet teeth 106, so that someone cannot push the handle 50 back in once the ratchet 102 has engaged the front tooth 197, until the ratchet 102 has passed the last tooth 108 of the ratchet teeth 106.

Additionally, there is an anti-cheat mechanism 110 (FIG. 4) which includes a lever 112 pivotally attached to the frame 11 by means of a pin 113. Lever 112 is also pivotally attached to a member 114, which is pivotally attached to a lever 116. This lever 116 is pivotally attached to the frame 11 at pin 118 and is biased upwardly by a tension spring 120, which is attached at one end to a bracket 122 rigidly attached to the frame 11. The spring 120 is also attached at the other end thereof to the lever 116, thereby pulling it upwardly, and pulling the coin return lever 18 upwardly to the position shown in FIG. 4. Consequently, if a person decided to try to pull the handle 50 outwardly after having deposited the proper amount of money in the machine and gets to the point wherein the teeth 106 are engaged by the ratchet 102 and then trys to get his money back, this anti-cheat mechanism 110 will prevent the money from being returned because the end 124 of member 100 will prevent the rightmost end of the lever 112 from moving upwardly once the ratchet 102 has engaged the teeth 106.

Of course if the apparatus is in the position shown in FIG. 4 or the handle 50 has not been pulled outwardly and money has been inserted into the machine and no paper dispensed, then the coin return mechanism 18 could be pushed downwardly, which will, in turn, push the lever 126 downwardly. Since the lever 126 is attached to the lever 128 by means of a pin 130, the leftmost end of the lever 128 will reset the coin mechanism 80, by clearing the unit 80 (moving the cam to the starting position) so that it can register the proper amount of coins inserted in the machine. It is noted that a tension spring 132 is attached at one end to the lever 128 and at the other end to a bracket 134 rigidly attached to the frame 11, whereby the lever 138 is pivoted upwardly on the left side thereof and furthermore a compression spring 136 is used to bias the other end of the member 128 upwardly as can readily by appreciated from viewing FIG. 4.

At the same time that the coin return mechanism is moved downwardly to clear the mechanism 80 to indicate that no money of the customer's is currently in the machine, the money will be returned to reflect that situation because lever 138 at the bottom part thereof will cause the coin to be returned to the customer into the opening 20 by conventional means.

Assuming now that the customer's money is indeed in the coin mechanism 80 and that the return function or anti-cheat mechanisms are not involved, then the rod 90 is held up and the end 96 of the lever 92 does not pass into the opening 98 in the member 100 as the handle 50 is pulled outwardly from the vending machine 10. During this movement of handle 50, the topmost paper 30, as shown in FIG. 5, will be forced against the wheels 34 and 36, thereby frictionally engaging them. Because of oneway bearings 140 within each of the wheels 34 and 36, the wheels 34 and 36 will not rotate in a counterclockwise direction when viewed from the FIG. 5 position. Consequently, when the handle 50 is pulled outwardly from the position in FIG. 5 to the position shown in FIG. 8, the frictional engagement of the wheels 34 and 36 against the topmost newspaper 30 will cause it to move outwardly to the position shown in FIG. 8. The movement of the wheel assembly caused by the handle 50 is achieved because the handle 50 is rigidly connected to the front 52 of the sheet metal member 60, and as the sheet metal member 60 is moved outwardly, the slot 64 will move to the left as shown in FIG. 5 with respect to the pin 66 in the member 38. When the slot 64 in member 60 is moved from the position shown in FIG. 5 with respect to the pin 66 to the position of the slot 64 with respect to the pin 66 in FIG. 8, then the rest of the wheel assembly 32 will be pulled outwardly, except for the fact that initially the assist structure 142 will be retained by a tension spring 148 connected to the rearmost rod 40 and to the member 142 if apparatus 20 is set to dispense a daily paper. Consequently, the topmost newspaper 30 will start to move with respect to the assist member 142 initially, and the back part 144 of the assist member 142 will drop down over the back end of the topmost paper 30, for example as shown in FIG. 8, after the topmost newspaper 30 passes the member 144; and, then after the frontmost rod 41 moves from the rear part of the slot 146 in the member 142 as shown in FIG. 5 to the front part of the slot 146 in member 142, the assist mechanism 142 will be pulled along with the rest of the wheel assembly 32, for example as it is being pulled along as shown in FIG. 8, with the member 144 pushing on the back of the topmost newspaper 30.

Figure 8:
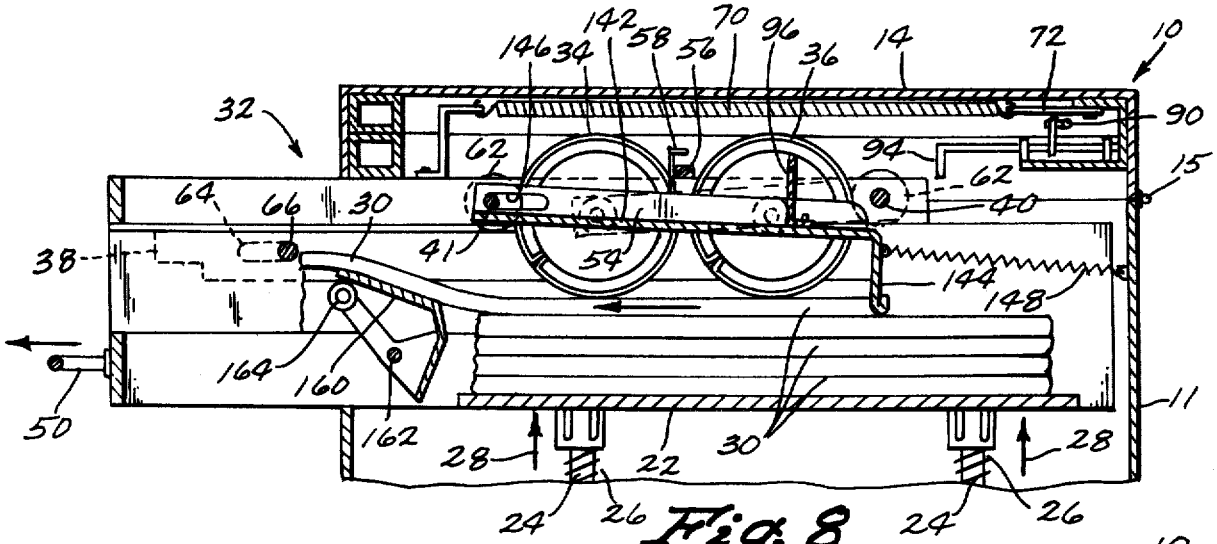
FIG. 8 is a view like FIG. 5, but showing the apparatus dispensing a newspaper.
Figure 9:
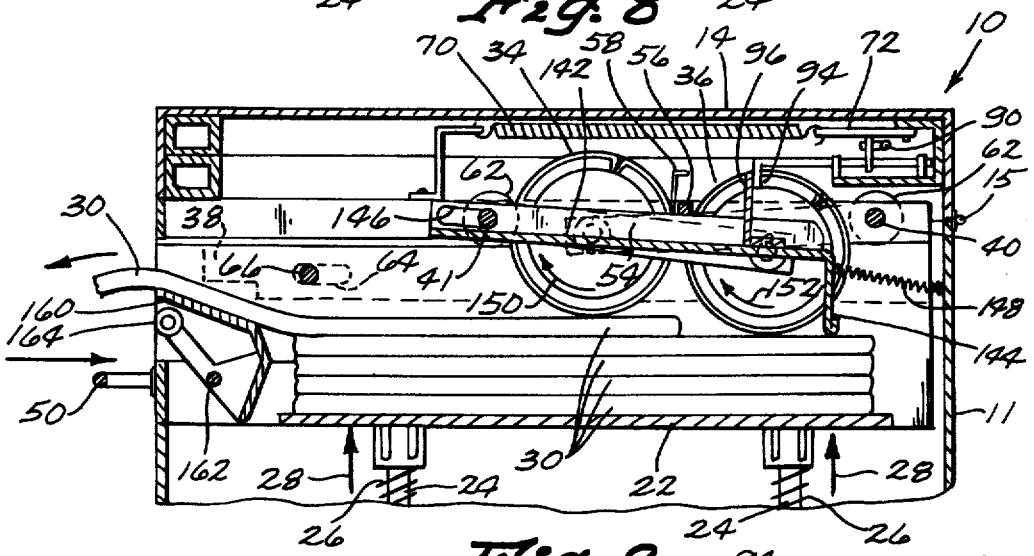
FIG. 9 is a view like FIGS. 5 and 8, but showing the final stage of the dispensing process and the readying of the machine for the next newspaper dispensing cycle.

After the wheel assembly has been pulled completely outwardly, for example approximately to the position shown in FIG. 8, then the handle 50 will be released and the tension springs 70 will pull the wheel assembly 32 backwardly into the machine 10 to the position shown in FIG. 9. When this has been done, then the newspaper 30 which is sticking out of the front of the machine can be grasped by the customer and pulled out of the machine 10, and the one-way bearings in the wheels 34 will allow the wheels 34 to rotate in a clockwise direction and allow the newspaper to be removed.

It is also important to note that when the wheels 34 and 36 are moved from the position shown in FIG. 8 to the position shown in FIG. 9, they will rotate clockwise in the direction of the arrows 150 and 152, to thereby readily move over the topmost paper and over the next to the topmost paper as shown in FIG. 9. The machine 10 will then be ready to repeat the cycle beginning with the position shown in FIG. 5, moving to FIG. 8 position and returning to FIG. 9 position.

Figure 10:
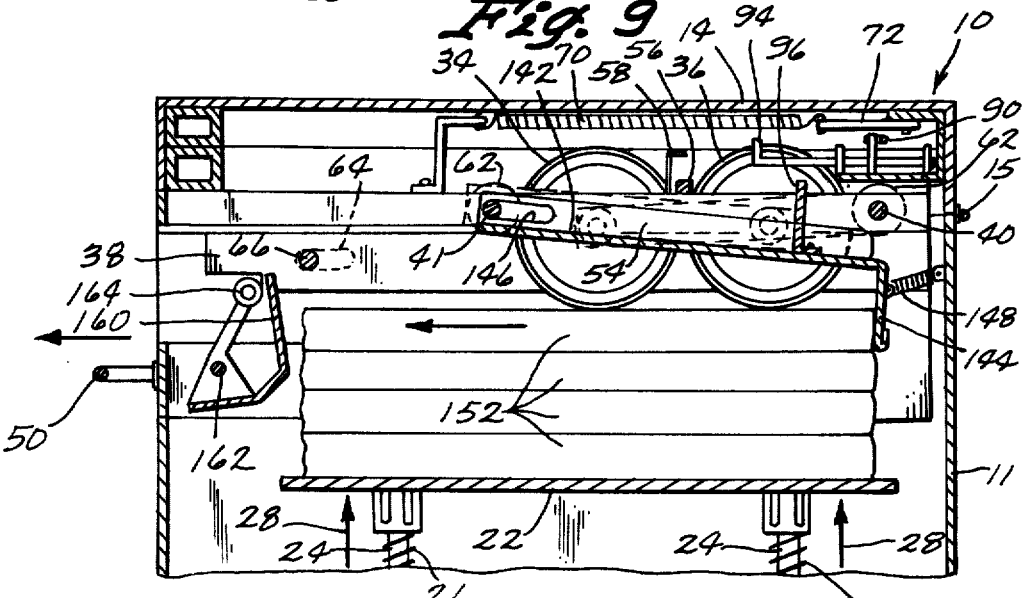
FIG. 10 is a view like FIG. 5, showing an initial stage of the newspaper vending cycle except that is shows the newspaper assist mechanism in a thick newspaper position for vending thicker newspapers than in the position of the assist mechanism in FIGS. 5, 8 and 9.

When it is desired to dispense a thicker paper in the newspaper vending apparatus 10 than newspapers 30, then the key 86 would be placed in the mechanism 20 as shown in FIGS. 2 and 4 and turned to the Sunday position. Referring to FIG. 4, it will be noted that the key 86 will change the operative cam on the coin unit 80 through linkages 82–85, for example as shown in U.S. patent application Ser. No. 391,565, which is incorporated herein by reference. At the same time that this price change is accomplished, the key 86 will also turn the rods 88 and 90, the lever 92 and ultimately it will turn the key locking element 94 from the position shown in FIG. 5 to the position shown in FIG. 10. When this is done, then the assist mechanism 142 will be available to drop down over a thicker paper 152 (FIG. 10) from the very start of the dispensing cycle. In other words, once the member 94 is turned to the position shown in FIG. 5 to the position shown in FIG. 10, the spring 148 will pull the member 142 rearwardly, so that part 144 will move down behind the topmost newspaper 152. Then when the handle 50 is pulled outwardly, the sheet metal member 60 of the wheel assembly 32 will first move such that the slot 64 therein will move with respect to the pin 66, as explained above, and then when the slot 64 engages the pin 66, the rest of the wheel assembly, including the members 38 and rods 40 and 41 will begin to move outwardly as well. As this is done, the portion 144 of the member 148 will be in back of the top thicker paper 152, and the top paper 152 will be pushed outwardly by member 144 at the same time that the top of the newspaper 152 will be engaged by the wheels 34 and 36 by friction (in the same manner that a thinner newspaper would be engaged as explained above) and the combination of the frictional engagement wheels 34 and 36 pulling on the newspaper and the pushing on the back of the newspaper by the end 144 of the flange 142, the newspaper will positively be moved to the position shown in FIG. 8. Then when the handle 50 is released, the topmost newspaper 152 will be in the same position as the newspaper 30 sticking out of the front of the machine as shown in FIG. 9.

A guard member 160 is pivotally attached by pin 162 to the front of the frame 11, for the purpose of preventing access to the stack of newspapers within the machine. It will be appreciated that the front notch of the members 38 contacts rollers 164, as shown in FIG. 5; and, consequently, as the member 38 is moved outwardly, the roller 164 is pushed from the position shown in FIG. 5 to the positions shown in FIGS. 8 and 9. The guard 160 is biased to the position shown in FIG. 5 by a spring, not shown.

Referring again to FIG. 4, it is noted that a pulley-like roller 166 is rotatably attached to the member 100, and that when the member 100 moves with the rest of the wheel assembly 32, the roller 166 rolls along the top of a lever 168, which is pivotally attached to the frame 11 at the pin 170. When the roller 166 rolls over the hump 172 of the lever 168, the lever 168 is pushed downwardly, thereby pushing the lever 174 downwardly. The lever 174 has a slot 176 therein and a pin 130 extends through the slot 176, such that when the lever 174 is pushed downwardly, the reset lever 128 also moves downwardly, thereby clearing the coin unit 80 so that the proper amount of coins must be placed into the machine in order for the next newspaper to be dispensed. The compression spring 136 pushes up on the member 128 and thereby biases the member 168 to the position shown in FIG. 4.

Obviously, many modifications and variations of the present invention are possible in light of the above teachings. It is therefore to be understood that, within the scope of the appended claims, the invention may be practiced otherwise than as specifically described.

We claim:

1. Apparatus for dispensing newspapers one at a time, comprising:

a frame;

a wheel assembly movably attached to said frame;

at least one wheel having a rotational axis;

means for allowing said wheel to rotate in a first rotational direction about said rotational axis and preventing said wheel from rotating in a second rotational direction about said rotational axis;

platform means for holding a plurality of newspapers;

means for biasing said platform means a third direction towards said wheel whereby the newspaper on said platform means nearest said wheel will contact said wheel;

means for allowing movement of said wheel and wheel assembly with respect to said platform means in a fourth direction generally transverse to said third direction and generally transverse with respect to the axis of said wheel whereby said wheel is prevented from rotating in said second rotational direction and is frictionally engaged with said newspaper in contact with said wheel, thereby causing said newspaper to move generally in said fourth direction to be removed from said platform means;

means for allowing said wheel and wheel assembly to move in a fifth direction generally transverse to the axis of rotation, while at the same time permitting rotation of said wheel in said first rotational direction whereby said wheel will roll on the next newspaper on said platform means which is closest to said wheel; and assist means attached to said wheel assembly for selectively pushing on the rear edge of said newspaper in engagement with said wheel when said wheel is moving in said fourth direction for helping to dispense thick newspapers.

2. The apparatus of claim 1 including lock out means for selectively preventing a portion of said assist means to pass behind said stack of newspapers when thin newspapers are being dispensed or allowing said portion of said assist means to pass behind said stack of newspapers when thick newspapers are being dispensed.

3. The apparatus of claim 2 wherein said assist means includes lost motion means for causing said portion of said assist means to delay movement with said wheel assembly until the rear of the topmost newspaper passes by said portion of said assist means.

4. The apparatus as defined in claim 1 including means for biasing said wheel assembly to a first position and movable in opposition to said fourth direction to a second position thereof.

5. The apparatus as defined in claim 1 wherein a second wheel is attached to said wheel assembly.

6. The apparatus of claim 1 including a coin receiving unit and locking means for preventing movement of said wheel assembly unless said locking means is unlocked by insertion of a proper amount of money into said coin receiving unit.

* * * * *